US008701891B2

(12) United States Patent
Bontrager et al.

(10) Patent No.: US 8,701,891 B2
(45) Date of Patent: Apr. 22, 2014

(54) ENERGY DISSIPATION STRUCTURE WITH SUPPORT PILLAR FOR PACKAGING FRAGILE ARTICLES

(71) Applicant: Strategic Outsourced Services LLC, Ripon, CA (US)

(72) Inventors: Richard Louis Bontrager, Ripon, CA (US); Randall Glenn Strange, Manteca, CA (US)

(73) Assignee: Strategic Outsourced Services LLC, Ripon, CA (US)

( * ) Notice: Subject to any disclaimer, the term of this patent is extended or adjusted under 35 U.S.C. 154(b) by 0 days.

(21) Appl. No.: 13/970,232

(22) Filed: Aug. 19, 2013

(65) Prior Publication Data

US 2014/0034547 A1 Feb. 6, 2014

Related U.S. Application Data

(63) Continuation-in-part of application No. 13/559,132, filed on Jul. 26, 2012, now Pat. No. 8,511,473.

(51) Int. Cl.
*B65D 81/02* (2006.01)

(52) U.S. Cl.
USPC ..... 206/587; 206/594

(58) Field of Classification Search
USPC ..... 206/521, 523, 586, 587, 588, 591, 592, 206/593, 594, 453
See application file for complete search history.

(56) References Cited

U.S. PATENT DOCUMENTS

| | | | | | |
|---|---|---|---|---|---|
| 5,628,402 | A * | 5/1997 | Dickie et al. | ..... | 206/521 |
| 5,678,692 | A * | 10/1997 | Gratz | ..... | 206/453 |
| 6,082,543 | A * | 7/2000 | Beliveau | ..... | 206/523 |
| RE37,253 | E * | 7/2001 | Moren et al. | ..... | 206/586 |
| 6,405,866 | B2 * | 6/2002 | Arima | ..... | 206/453 |
| 8,511,473 | B1 * | 8/2013 | Bontrager et al. | ..... | 206/587 |
| 2004/0055928 | A1 * | 3/2004 | Smith | ..... | 206/586 |
| 2013/0134069 | A1 * | 5/2013 | Babey et al. | ..... | 206/587 |

* cited by examiner

*Primary Examiner* — Jacob K Ackun
(74) *Attorney, Agent, or Firm* — Meyer IP Law Group

(57) ABSTRACT

In specific embodiments, an energy dissipation structure for supporting an article comprises a cavity adapted to receive at least a portion of the article. The cavity is bounded by a plurality of sidewall structures, each of the sidewall structures having a length and including an inner wall, an outer wall, and an arcuate structure connecting the inner wall with the outer wall. Each of the sidewall structures is connected with another of the sidewall structures by a groove extending along at least a portion of the inner walls, the outer walls, and the arcuate structures of the connected sidewall structures. The cavity includes a platform adapted to supported the article above the base when the article is seated within the cavity and a support pillar extending from the platform toward the base.

19 Claims, 17 Drawing Sheets

ENERGY DISSIPATION STRUCTURE WITH SUPPORT PILLAR FOR PACKAGING FRAGILE ARTICLES

CLAIM OF PRIORITY

This patent application is a Continuation-In-Part of U.S. patent application Ser. No. 13/559,132 filed on Jul. 26, 2012, now U.S. Pat. No. 8,511,473, issued Aug. 20, 2013, entitled "ENERGY DISSIPATION STRUCTURE FOR PACKAGING FRAGILE ARTICLES", by Richard Louis Bontrager, et al. which is incorporated herein by reference.

TECHNICAL FIELD

The present invention relates to structures used for shipping articles, and more particularly structures for supporting and protecting a shock and/or vibration sensitive article inside a shipping carton.

BACKGROUND

Shock and/or vibration sensitive articles (i.e., "fragile articles"), such as hard disk drives and other electronic equipment, require special packaging when shipped inside shipping cartons. Conventional packaging includes paper, preformed polystyrene foam or beads, etc. Ideally, the packaging absorbs and dissipates shocks and/or vibrations impinging the shipping carton to minimize the shocks and/or vibrations experienced by the fragile article.

Conventional carton packaging materials are inadequate to meet the current, stringent requirements for shock and/or vibration absorption. In order to satisfy such requirements, voluminous carton packaging materials are required to cushion fragile articles. Voluminous packaging materials are expensive and take up excessive space before and after use. Further, voluminous carton packaging materials necessitate larger shipping cartons, which are more expensive to purchase and ship. The shock and/or vibration dissipation performance of current packaging materials can depend in large part on how the user packages the fragile article. If a particular conventional carton packaging is deemed to provide inadequate protection, the remedy is to add additional packaging material, thereby increasing the shipping carton size.

Unitary packaging structures have been developed that are made of flexible polymeric materials to allow shocks and vibrations to dissipate through flexing of the structure walls. Many unitary packaging structures are designed to dissipate shocks and vibrations primarily in only one direction or fail to provide adequate protection under the stringent performance specifications from fragile article manufacturers. Such unitary packaging structure designs are not easily adapted to predictably change dissipation performance to meet changing specifications. Solutions have been proposed with varying degrees of success. There continues to be a need for improved solutions for packaging fragile articles.

SUMMARY

Embodiments of the present invention are related to energy dissipation structures for supporting fragile articles. In accordance with an embodiment, an energy dissipation structure for supporting an article comprises a cavity adapted to receive at least a portion of the article, wherein the cavity is bounded by a plurality of sidewall structures, each of the sidewall structures having a length and including an inner wall, an outer wall, and an arcuate structure connecting the inner wall with the outer wall. Each of the sidewall structures is connected with another of the sidewall structures by a groove extending along at least a portion of the inner walls, the outer walls, and the arcuate structures of the connected sidewall structures. The cavity includes a platform adapted to support the article above the base when the article is seated within the cavity and a support pillar extending from the platform toward the base.

In an embodiment the support pillar has a distal end that is arcuately shaped and extends toward the base of the energy dissipation structure. In some embodiments the support pillar extends approximately to the base.

In an embodiment, the groove connecting the sidewall structures have an arcuate shape. In an embodiment, the groove connecting the sidewall structures has a compound shape having one or more arcuate shapes.

In an embodiment, the energy dissipation structure comprises four sidewall structures so that the structure has an approximately rectangular footprint. In an embodiment, the outer walls of the sidewall structures extend from a base to the arcuate structure. The cavity is adapted to receive the article such that the article is suspended above the base.

In an embodiment, the outer walls extend at an acute angle relative to the respective inner walls from the base to the arcuate structure. In embodiment, a rib extends from each of the outer walls, wherein the at least one rib includes a face that is substantially parallel to the respective inner walls.

BRIEF DESCRIPTION OF THE FIGURES

Further details of embodiments of the present invention are explained with the help of the attached drawings in which:

FIG. 6 illustrates an energy dissipation structure in accordance with an embodiment of the present invention resembling the energy dissipation structure of FIG. 1.

FIG. 7 illustrates an energy dissipation structure in accordance with an alternative embodiment of the present invention.

FIG. 8 illustrates an energy dissipation structure in accordance with an alternative embodiment of the present invention.

DETAILED DESCRIPTION

Figure 1:
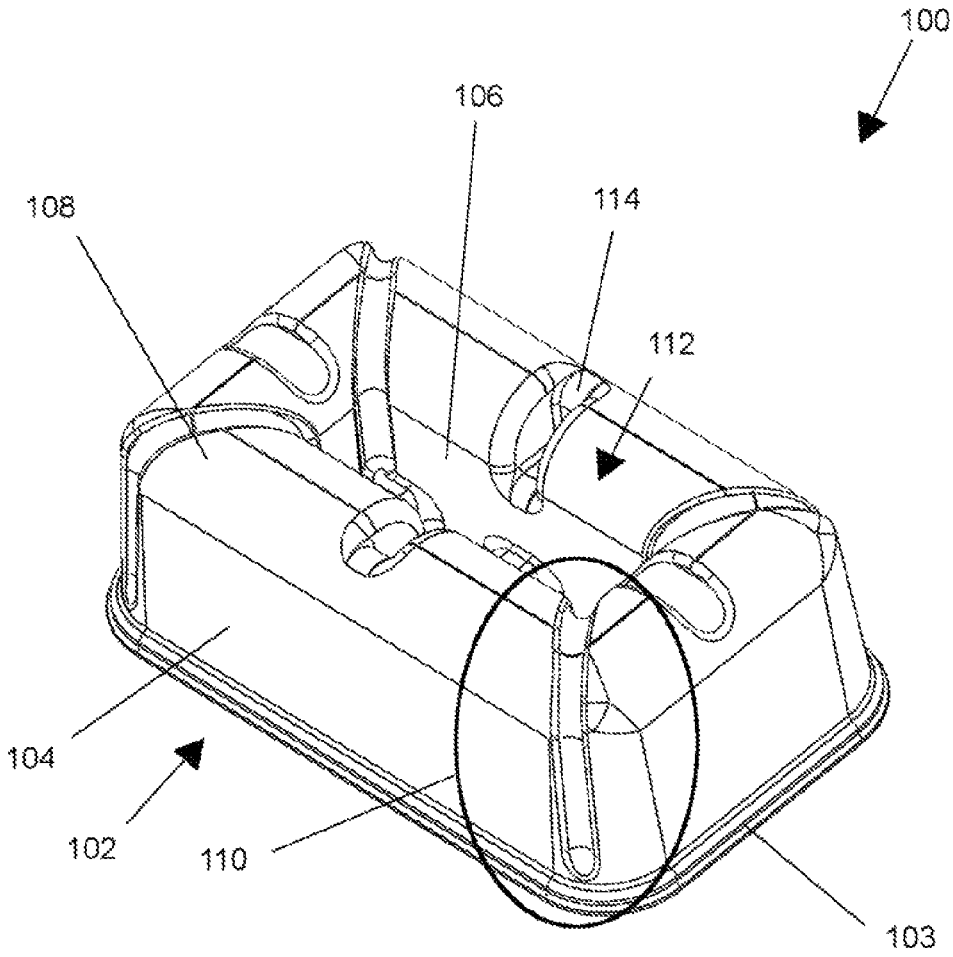
FIG. 1 is a perspective view of an energy dissipation structure in accordance with one embodiment of the present invention.

The following description is of the best modes presently contemplated for practicing various embodiments of the present invention. The description is not to be taken in a limiting sense but is made merely for the purpose of describing the general principles of the invention. The scope of the invention should be ascertained with reference to the claims. In the description of the invention that follows, like numerals or reference designators will be used to refer to like parts or elements throughout. In addition, the first digit of a reference number identifies the drawing in which the reference number first appears.

The present invention comprises an energy dissipation structure for supporting and protecting a shock and/or vibration sensitive article inside a shipping carton by dissipating shocks and vibrations experienced by the carton. The energy dissipation structures are nestable for space efficient storage before and after use, utilize minimal carton space to dissipate such shocks and vibrations, are lightweight, can be made with polymers or natural fibers, and have a structural design that can be easily modified to predictably meet a wide range of energy dissipation requirements.

FIG. 1 illustrates an embodiment of an energy dissipation structure 100 for supporting an article in accordance with the present invention comprising a sidewall 102 having a plurality of faces (also referred to herein as sidewall structures) connected at corners by grooves 110 that segregate the bearing surfaces of the sidewall 102 from each other. The sidewall 102 defines a cavity 112 for receiving at least a portion of the article. In preferred embodiments, the energy dissipation structure 100 can receive an end of the article and can be used in combination with an additional energy dissipation structure receiving an opposite end of the article. In addition, the energy dissipation structure 100 can be used in combination with additional structures receiving and supporting other portions of the article, such as structures arranged along and receiving the sides of the article.

As shown, the energy dissipation structure 100 includes a sidewall 102 having four faces and has an approximately rectangular footprint relative to a plane defined by a base 103 of the sidewall 102. Each of the faces of the sidewall 102 includes an outer wall 104 that acts as the bearing surface when impact occurs on the outside of the energy dissipation structure 100, and an inner wall 106 that acts as the bearing surface when impacted by the supported article (not shown) from inside the cavity 112. The inner wall 106 is connected with a platform (not visible) that extends between the faces of the inner wall 106 to support an article above a plane defined by the base 103. The outer wall 104 and inner wall 106 are connected by an arcuate structure 108. The grooves 110 extend along at least a portion of the outer wall 104, along the arcuate structure 108, and along at least a portion of the inner wall 106, and have a shape designed to distribute energy along its surface. As shown, the grooves 110 have an arcuate shape that forms a rounded indentation in the surface between the faces of the sidewall 102. In other embodiments, the grooves 110 can have some other shape, such as a compound shape. Hinge points at which the sidewall 102 flexes in the z-axis (where the plane defined by the base 103 represents the x- and y-axes) can be defined by modifying the depth and width of the grooves 110, and the portions of the outer wall 104 and inner wall 106 that the grooves 110 extend through. As shown in FIG. 1, the grooves 110 extend from over the entire inner wall 106 to just above a flange at the base 103.

The faces of the sidewall 102 can include one or more structures to stiffen the sidewall. Because the faces of the sidewall 102 are segregated by the grooves 110 such that the bearing surfaces are substantially isolated from an impact below a designed-for magnitude in designed-for directions, the one or more structures need only be designed to account for the stiffness of the individual face of the sidewall in which it is formed. As shown, the energy dissipation structure 100 of FIG. 1 includes a column 114 formed in each of the four faces of the sidewall 102.

Figure 2:
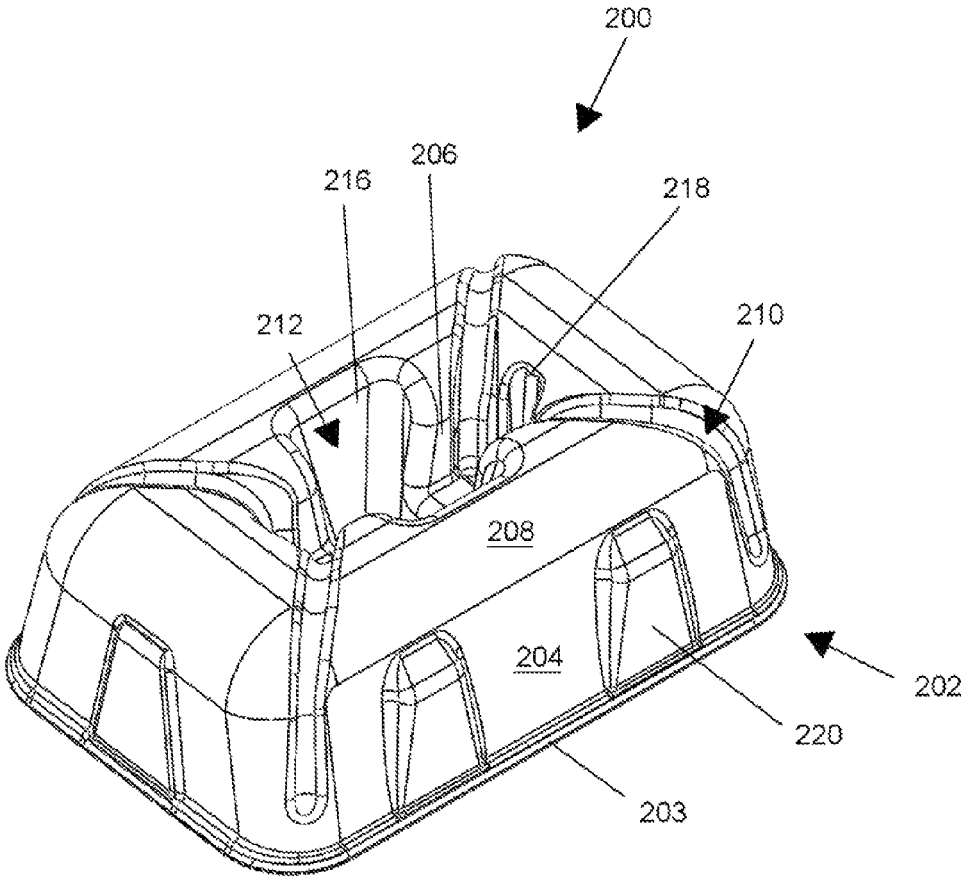
FIG. 2 is a perspective view of an energy dissipation structure in accordance with an alternative embodiment of the present invention.

FIG. 2 illustrates an alternative embodiment of an energy dissipation structure 200 for supporting an article in accordance with the present invention comprising a sidewall 202 having a plurality of faces connected at corners by grooves 210 that segregate the bearing surfaces of the sidewall 202 from each other. As above, the sidewall 202 defines a cavity 212 for receiving at least a portion of the article. The energy dissipation structure 200 can receive an end of the article and can be used in combination with an additional energy dissipation structure receiving an opposite end of the article. In addition, the energy dissipation structure 200 can be used in combination with additional structures receiving and supporting other portions of the article, such as structures arranged along and receiving the sides of the article.

The energy dissipation structure 200 includes a sidewall 202 having four faces and has an approximately rectangular footprint relative to a plane defined by a base 203 of the sidewall 202. Each of the faces of the sidewall 202 includes an outer wall 204 that acts as the bearing surface when impact occurs on the outside of the energy dissipation structure 200, and an inner wall 206 that acts as the bearing surface when impacted by the supported article (not shown) from inside the cavity 212. The inner wall 206 is connected with a platform (not visible) that extends between the faces of the inner wall 206 to support an article above a plane defined by the base 203. The inner wall 206 of the sidewall 202 includes two pairs of slots 216, 218 with each pair formed in opposite faces of the sidewall 202. The pairs of slots 216, 218 receive differently sized articles. As shown, a narrow pair of slots 218 is formed in faces separated by a larger distance than the wide pair of slots 216. Thus for example, the narrow slots 218 can accommodate a thinner and wider (or longer) article, while the wide slots 216 can accommodate a thicker and narrower (or shorter) article. The outer wall 204 and inner wall 206 are connected by an arcuate structure 208. The grooves 210 extend along at least a portion of the outer wall 204, along the arcuate structure 208, and along at least a portion of the inner wall 206, and have a shape designed to distribute energy along its surface. As shown, the grooves 210 have an arcuate shape that forms a rounded indentation in the surface between the faces of the sidewall 202. In other embodiments, the grooves 210 can have some other shape, such as a compound shape. Hinge points at which the sidewall 202 flexes in the z-axis (where the plane defined by the base 203 represents the x- and y-axes) can be defined by modifying the depth and width of the grooves 210, and the portions of the outer wall 204 and inner wall 206 that the grooves 210 extend through. As shown in FIG. 2, the grooves 210 extend from over the entire inner wall 206 to slightly higher above the base 203 when compared with the embodiment of FIG. 1.

As shown in FIG. 2, the outer wall 204 of the sidewall 202 extends upward from the base 203 at an acute angle relative to a plane perpendicular to the plane defined by the base 203. The acute angle of the outer wall 204 (i.e., the taper of the outer wall) may result from a draft of a mold used to form the energy dissipation structure. The energy dissipation structure can be manufactured by molding (for example, by injection molding, or thin-walled molding) or by an alternative process such as extrusion. In molding, an energy dissipation structure is formed in a mold and once formed, must be ejected or otherwise removed from the mold. Some manufacturers utilize a thin-walled molding process wherein injection is accelerated with nitrogen, reducing manufacturing time. To improve removal of an energy dissipation structure, the mold can be designed such that the mold includes a draft. A draft is a slight taper given to a mold or die to facilitate the removal of a casting. The size of the draft can vary according to the composition of the resin injected into the mold, the depth of the mold relative to the width of the mold, the desired ease of removal of the energy dissipation structure from the mold and other manufacturing considerations. When placed in a shipping carton, the sidewall may or may not respond to impact to the shipping carton in a predictable fashion due to the taper of the outer wall resulting from the draft. To enhance the predictability of response of the energy dissipation structure 200, the faces of the sidewall includes at least one rib 220 formed on the outer wall 204. The at least one rib has a face that is substantially perpendicular to a plane defined by the base 203 and parallel to a plane formed by a shipping carton so that the sidewall structure 202 is engaged when the shipping carton is impacted, thereby impacting the face of the at least one rib 220.

In some embodiments, the at least one rib 220 can have an overall trapezoidal shape such that the width of the rib 220 at the lower edge is wider than the width of the rib 220 at the peak of the arcuate shape. The divergence angle formed between two non-parallel sides of the trapezoid shaped rib 220 can be defined by the requirements of the manufacturing process. The shape of the at least one rib 220 is limited by the manufacturing process and can be driven by a number of variables. A draft can be included to improve manufacturing by easing the ejection or removal of the energy dissipation structure from the mold. Ease of removal of the energy dissipation structure from the mold can be minimized by including ribs that require only a fraction of the surface area of the mold to have only a slight draft, or no draft. The ease of ejection or removal of the energy dissipation structure can be balanced against the advantages of the size and shape of the rib until a desired result is produced.

Figure 3:
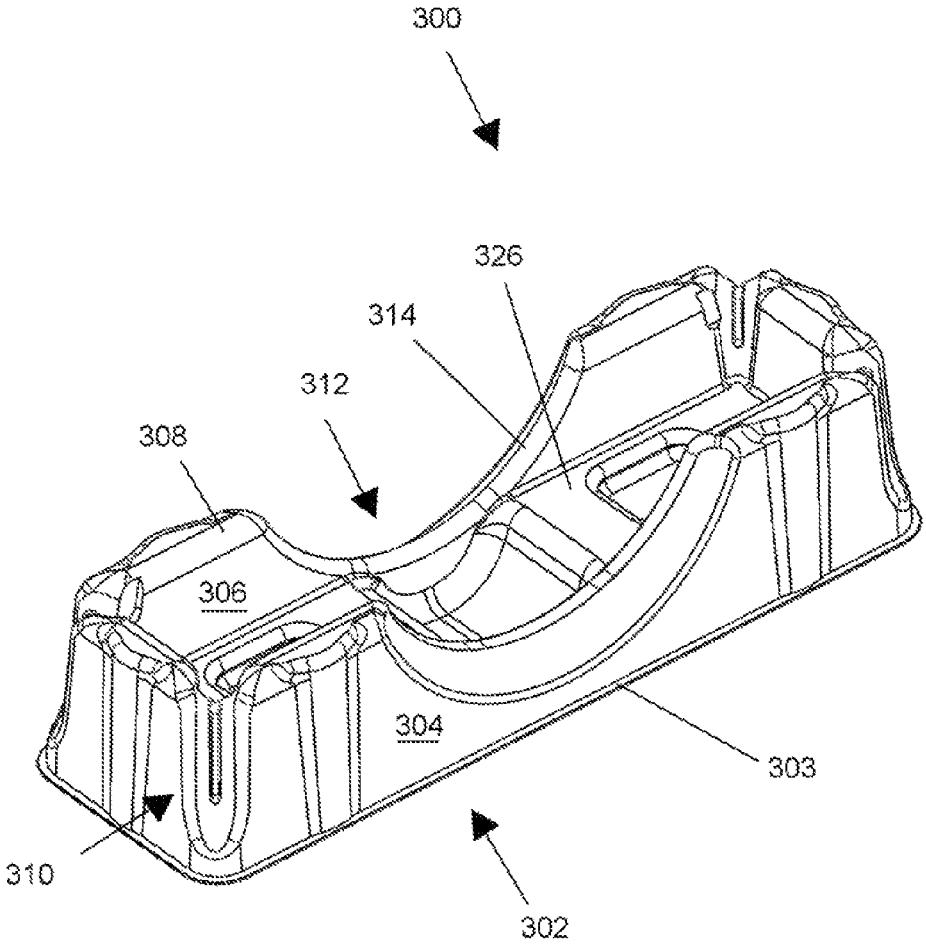
FIG. 3 is a perspective view of an energy dissipation structure in accordance with a further embodiment of the present invention.

FIG. 3 illustrates an alternative embodiment of an energy dissipation structure 300 for supporting an article in accordance with the present invention comprising a sidewall 302 having a plurality of faces connected at corners by grooves 310 that segregate the bearing surfaces of the sidewall 302 from each other. As with the previous embodiments, the sidewall 302 defines a cavity 312 for receiving at least a portion of the article. The energy dissipation structure 300 can receive an end of the article and can be used in combination with an additional energy dissipation structure receiving an opposite end of the article. In addition, the energy dissipation structure 300 can be used in combination with additional structures receiving and supporting other portions of the article, such as structures arranged along and receiving the sides of the article.

The energy dissipation structure 300 includes a sidewall 302 having four faces and has an approximately rectangular footprint relative to a plane defined by a base 303 of the sidewall 302. Each of the faces of the sidewall 302 includes an outer wall 304 that acts as the bearing surface when impact occurs on the outside of the energy dissipation structure 300, and an inner wall 306 that acts as the bearing surface when impacted by the supported article (not shown) from inside the cavity 312. The inner wall 306 is connected with a platform 326 that extends between the faces of the inner wall 306 to support an article above a plane defined by the base 303. The outer wall 304 and inner wall 306 are connected by an arcuate structure 308. The grooves 310 extend along at least a portion of the outer wall 304, along the arcuate structure 308, and along at least a portion of the inner wall 306, and have a shape designed to distribute energy along its surface. As shown, the grooves 310 have a compound structure with a broad, arcuate portion and a deeper, narrower portion that extends a portion of the broad, arcuate portion, the compound structure forming an indentation in the surface between the faces of the sidewall 302. The energy dissipation structure 300 of FIG. 3 includes a narrow width and a substantially longer length. The faces of the sidewall 302 extending along the length include a downward curving feature 314 having an arcuate shape that extends into the sidewall 302 from the arcuate structure 308 toward the base 303.

Figure 4:
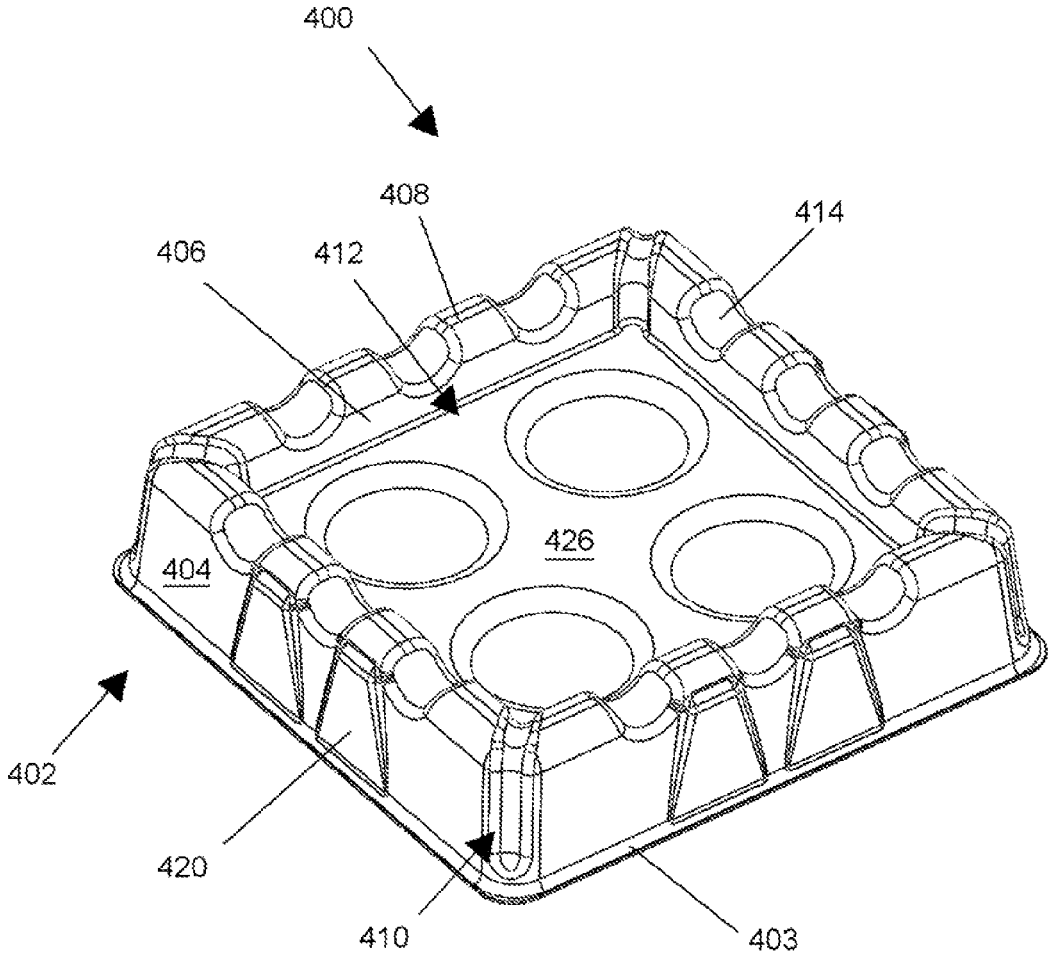
FIG. 4 is a perspective view of an energy dissipation structure in accordance with a further embodiment of the present invention.

FIG. 4 illustrates a further embodiment of an energy dissipation structure 400 for supporting an article in accordance with the present invention comprising a sidewall 402 having a plurality of faces connected at corners by grooves 410 that segregate the bearing surfaces of the sidewall 402 from each other. As above, the sidewall 402 defines a cavity 412 for receiving at least a portion of the article. The energy dissipation structure 400 can receive an end of the article and can be used in combination with an additional energy dissipation structure receiving an opposite end of the article. In addition, the energy dissipation structure 400 can be used in combination with additional structures receiving and supporting other portions of the article, such as structures arranged along and receiving the sides of the article.

The energy dissipation structure 400 includes a sidewall 402 having four faces and has an approximately square footprint relative to a plane defined by a base 403 of the sidewall 402. Each of the faces of the sidewall 402 includes an outer wall 404 that acts as the bearing surface when impact occurs on the outside of the energy dissipation structure 400, and an inner wall 406 that acts as the bearing surface when impacted by the supported article (not shown) from inside the cavity 412. The inner wall 406 is connected with a platform 426 that extends between the faces of the inner wall 406 to support an article above a plane defined by the base 403. The outer wall 404 and inner wall 406 are connected by an arcuate structure 408. The grooves 410 extend along at least a portion of the outer wall 404, along the arcuate structure 408, and along at least a portion of the inner wall 406, and have a shape designed to distribute energy along its surface. As shown, the grooves 410 have an arcuate shape that forms a rounded indentation in the surface between the faces of the sidewall 402. In other embodiments, the grooves 410 can have some other shape, such as a compound shape. Hinge points at which the sidewall 402 flexes in the z-axis (where the plane defined by the base 403 represents the x- and y-axes) can be defined by modifying the depth and width of the grooves 410, and the portions of the outer wall 404 and inner wall 406 that the grooves 410 extend through. As shown in FIG. 4, the grooves 410 extend from over the entire inner wall 406 to slightly higher above the base 403.

As shown in FIG. 4, the outer wall 404 of the sidewall 402 extends upward from the base 403 with a slight taper defined by a draft of a mold, similar to the embodiment of FIG. 2. To enhance the predictability of response of the energy dissipation structure 400, the faces of the sidewall 402 each include a pair of ribs 420 formed on the outer wall 404. The rib 420 have faces that are substantially perpendicular to a plane defined by the base 403 and parallel to a plane formed by a shipping carton when placed in the shipping carton so that the sidewall structure 402 is engaged when the shipping carton is impacted, thereby impacting the face of the ribs 420. Each of the faces of the sidewall 402 further include downward curving features 414 having an arcuate shape that extends into the sidewall 402 from the arcuate structure 408 toward the base 403. The curving features 414 are formed between ribs 420 and between the ribs 420 and the grooves 410.

Figure 5:
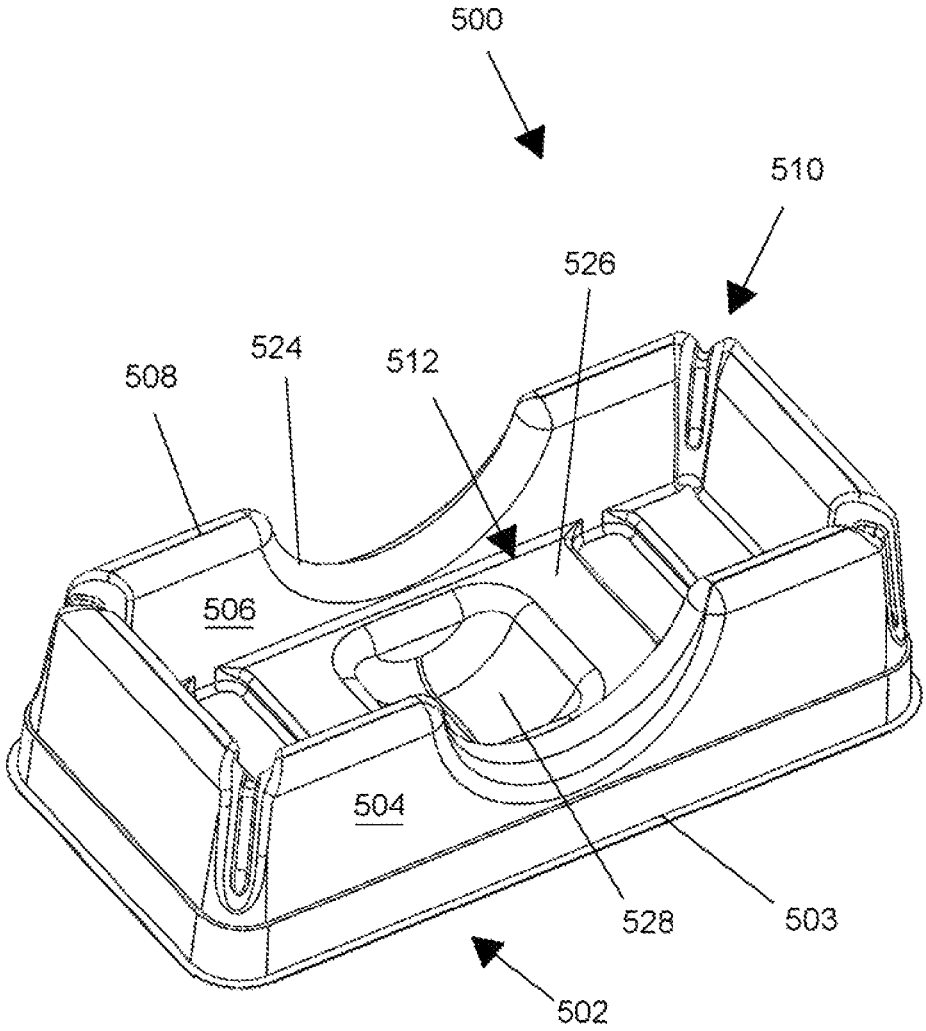
FIG. 5 is a perspective view of an energy dissipation structure in accordance with a further embodiment of the present invention.

FIG. 5 illustrates a further embodiment of an energy dissipation structure 500 for supporting an article in accordance with the present invention comprising a sidewall 502 having a plurality of faces connected at corners by grooves 510 that segregate the bearing surfaces of the sidewall 502 from each other. As with the previous embodiments, the sidewall 502 defines a cavity 512 for receiving at least a portion of the article. The energy dissipation structure 500 can receive an end of the article and can be used in combination with an additional energy dissipation structure receiving an opposite end of the article. In addition, the energy dissipation structure 500 can be used in combination with additional structures receiving and supporting other portions of the article, such as structures arranged along and receiving the sides of the article.

The energy dissipation structure 500 includes a sidewall 502 having four faces and has an approximately rectangular footprint relative to a plane defined by a base 503 of the sidewall 502. Each of the faces of the sidewall 502 includes an outer wall 504 that acts as the bearing surface when impact occurs on the outside of the energy dissipation structure 500, and an inner wall 506 that acts as the bearing surface when impacted by the supported article (not shown) from inside the cavity 512. The inner wall 506 is connected with a platform 526 that extends between the faces of the inner wall 506 to support an article above a plane defined by the base 503. The platform 526 has a bulbous feature 528 that extends toward the base 503 to help support the article. The outer wall 504 and inner wall 506 are connected by an arcuate structure 508. The grooves 510 extend along at least a portion of the outer wall 504, along the arcuate structure 508, and along at least a portion of the inner wall 506, and have a shape designed to distribute energy along its surface. As shown, the grooves 510 have a compound structure with a broad, arcuate portion and a deeper, narrower portion that extends a portion of the broad, arcuate portion, the compound structure forming an indentation in the surface between the faces of the sidewall 502. The energy dissipation structure 500 of FIG. 3 includes a narrow width and a substantially longer length. The faces of the sidewall 502 extending along the length include a downward curving feature 514 having an arcuate shape that extends into the sidewall 502 from the arcuate structure 508 toward the base 503.

Embodiments of the energy dissipation structure in accordance with the present invention can be made from high density polyethylene, a recyclable material having good tensile and tear properties at low temperatures, providing resiliency for shock and vibration absorption. Other materials that can be used to make the energy dissipation structure include: polyvinyl chloride, polypropylene, low density polyethylene, PETG, PET, styrene, and many other polymeric materials. In other embodiments, the energy dissipation structure can be made from molded fiber and other composites, for example a composite having both fiber and polymeric materials. In embodiments, the energy dissipation structure can be made from natural fibers, such as bamboo, palm, hemp, and other virgin fibers. The advantage of using virgin fibers is that such fibers are biodegradable and renewable. In general, the longer the natural fibers, the better the spring reacts and the more flexible the design that is permitted. In still other embodiments, the energy dissipation structure can be made from a foamed material having reduced density. The compound and/or composite material can further comprise non-polymeric materials such as glass, for providing stiffness as desired. One of ordinary skill in the art can appreciate the different materials from which the energy dissipation structures can be shaped and formed.

The spring system energy dissipation structures are fully nestable for efficient stackability to minimize storage space before and after use. Further, because of the resiliency of the energy dissipation structure material and spring system design, these energy dissipation structures can be re-used repeatedly. Energy dissipation structures are also lightweight to minimize shipment costs both of the energy dissipation structures before use, as well as during shipment of the articles utilizing the energy dissipation structures.

Figure 6A:
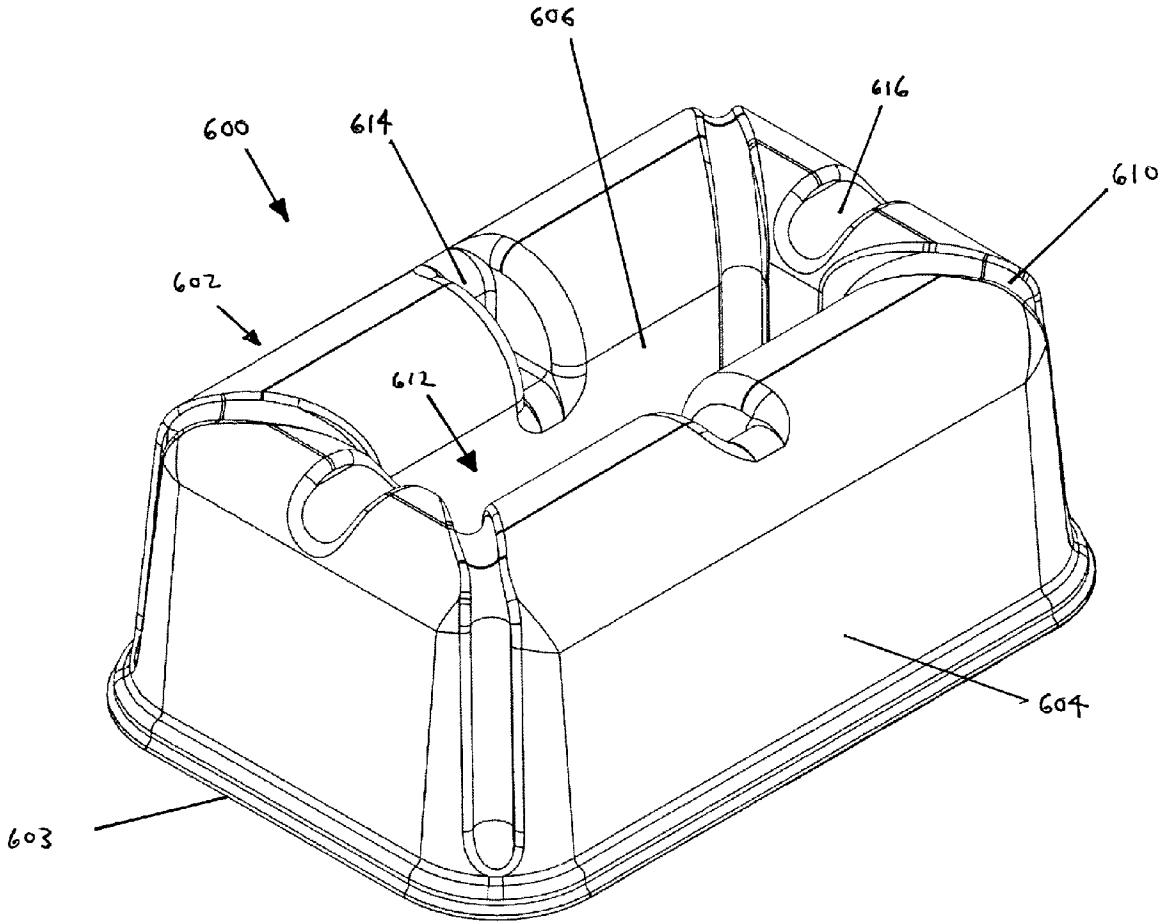
FIG. 6A is a perspective view of the energy dissipation structure.
Figure 6B:
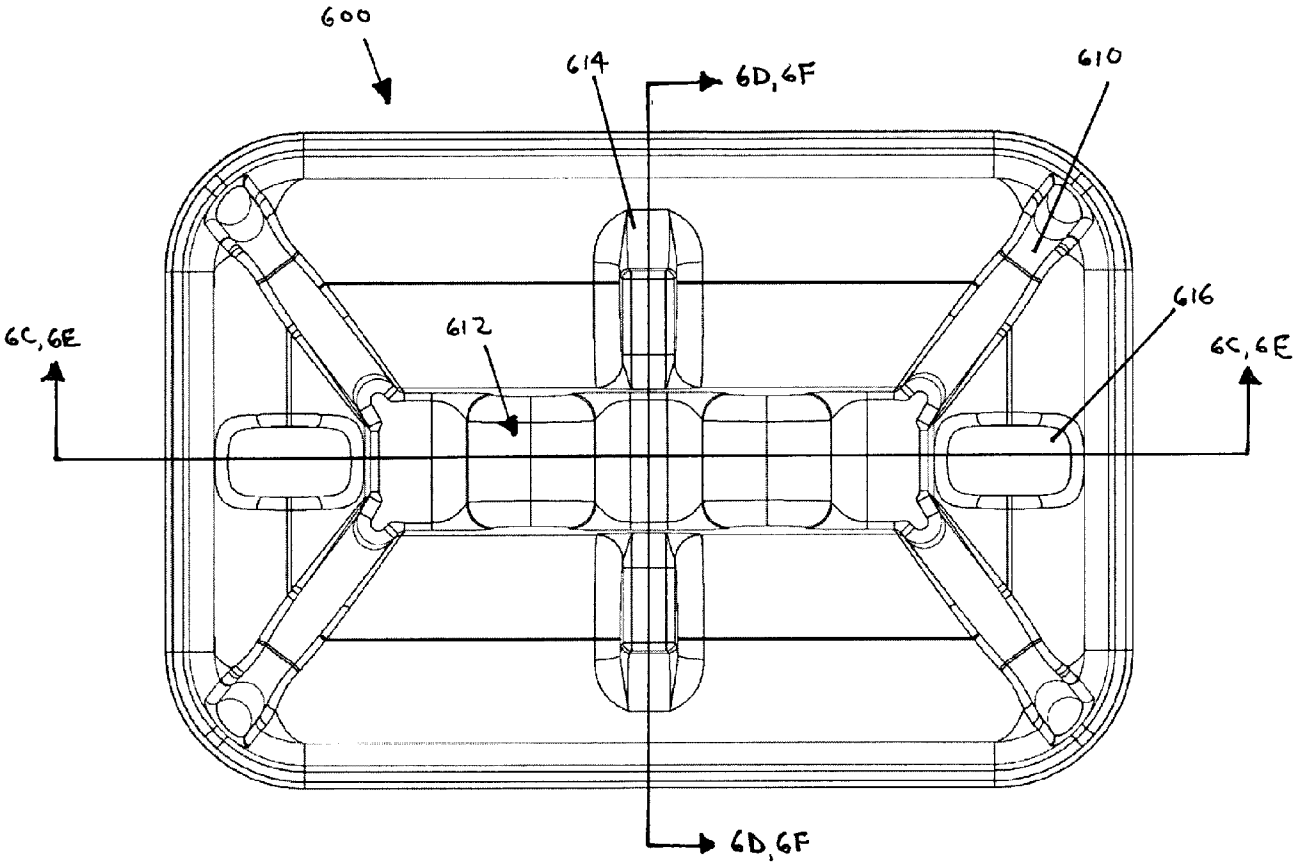
FIG. 6B is a top view of the energy dissipation structure.
Figure 6C:
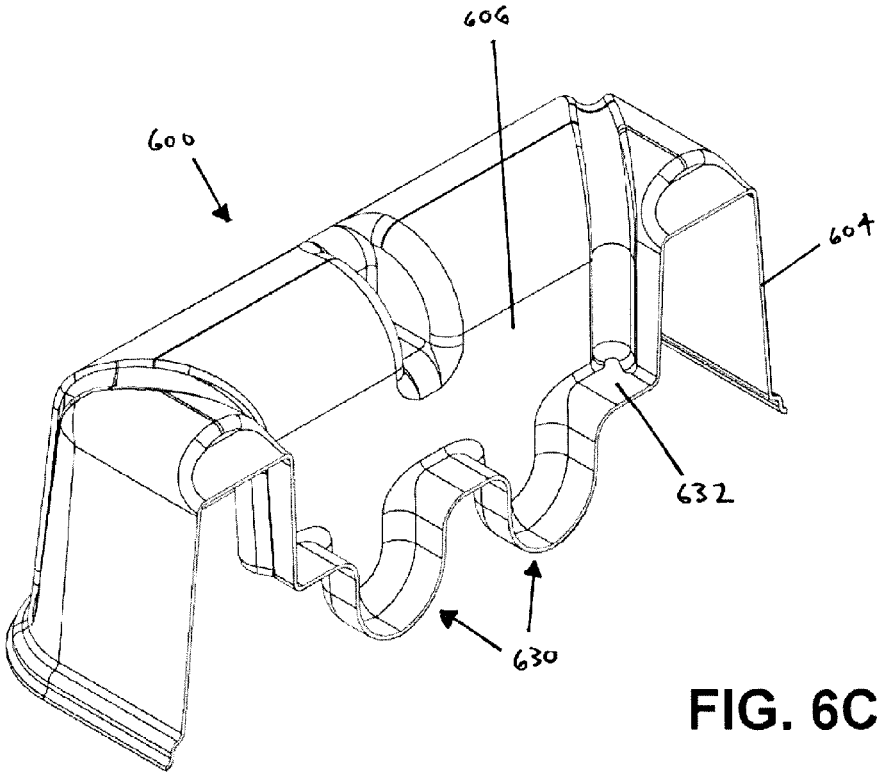
FIG. 6C is a perspective cross-sectional view along a length of the energy dissipation structure.
Figure 6D:
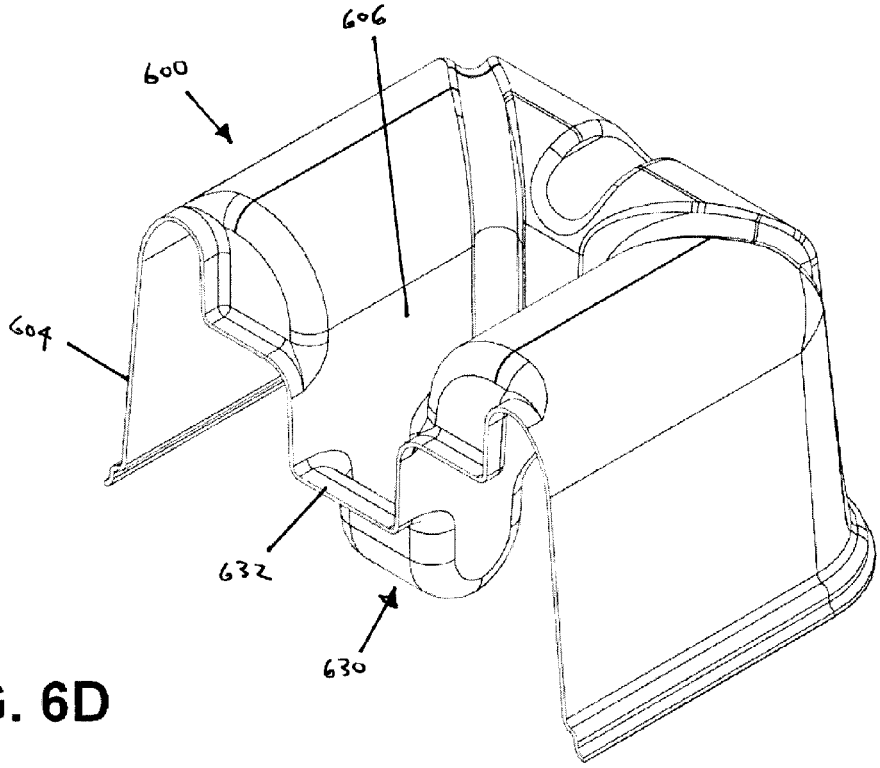
FIG. 6D is a perspective cross-sectional view along a width of the energy dissipation structure.

FIG. 6A illustrates an embodiment of an energy dissipation structure 600 for supporting an article in accordance with the present invention that resembles the energy dissipation structure 100 of FIG. 1. The energy dissipation structure 600 comprises a sidewall 602 having a plurality of faces (also referred to herein as sidewall structures) connected at corners by grooves 610 that segregate the bearing surfaces of the sidewall 602 from each other. The sidewall 602 defines a cavity 612 for receiving at least a portion of the article. Referring to FIG. 6B, a footprint of the cavity 612 can more clearly bee seen, and is generally rectangular in shape.

In preferred embodiments, the energy dissipation structure 600 can receive an end of the article and can be used in combination with an additional energy dissipation structure receiving an opposite end of the article. In addition, the energy dissipation structure 600 can be used in combination with additional structures receiving and supporting other portions of the article, such as structures arranged along and receiving the sides of the article.

Referring to FIGS. 6C-6F, the energy dissipation structure 600 includes a sidewall 602 having four faces defining a length and a width of the energy dissipation system 600. As mentioned, the footprint is approximately rectangular relative to a plane defined by a base 603 of the sidewall 602. The inner wall 606 is connected with a platform 632 that extends between the faces of the inner wall 606 to support an article above a plane defined by the base 603. Each of the faces of the sidewall 602 includes an outer wall 604 that acts as a bearing surface. Further, a pair of support pillars 630 extends separately from the platform 632 to substantially a depth of the base 603. The platform 632 acts as the bearing surface when impacted by the supported article (not shown) from inside the cavity 612 and transfers impact forces at least partially to the pair of support pillars 630, which can at least partially collapse and/or deform in response to the impact forces to thereby dissipate such impact forces. As can be seen, each of the support pillars 630 has an arcuate structure to distribute force along the support pillar's surface.

Figure 6E:
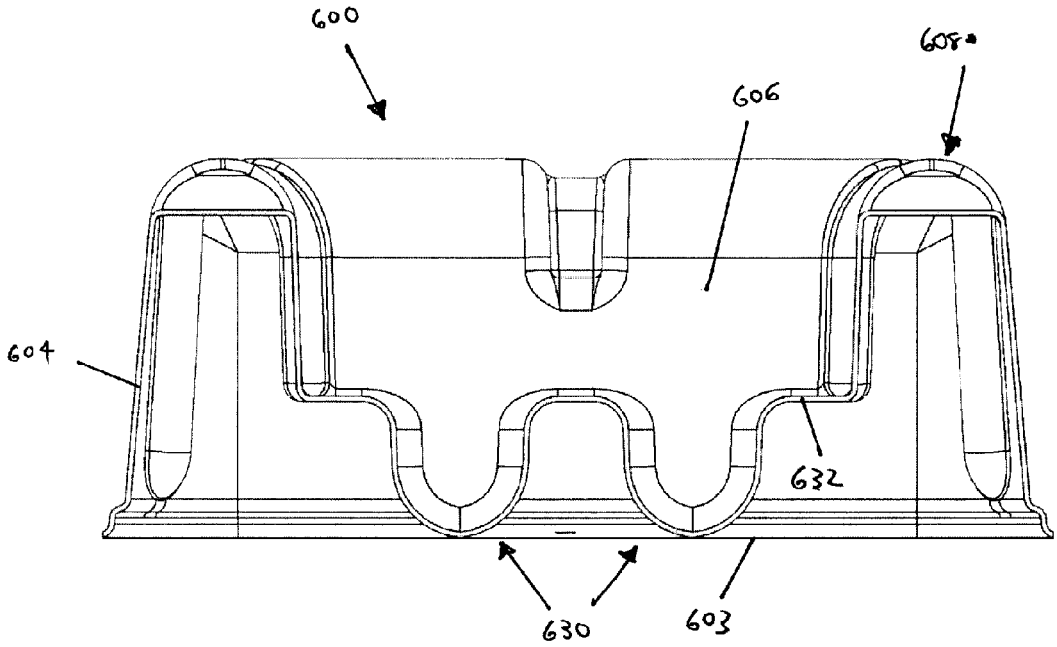
FIG. 6E is a cross-sectional view along the length of the energy dissipation structure.
Figure 6F:
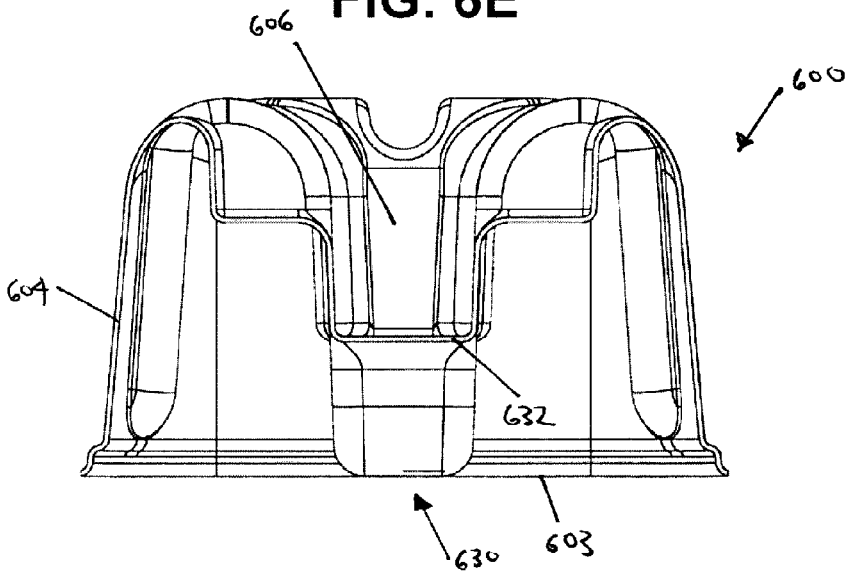
FIG. 6F is cross-sectional view along the width of the energy dissipation structure.

The outer wall 604 and inner wall 606 are connected by a further arcuate structure 608. The grooves 610 extend along at least a portion of the outer wall 604, along the arcuate structure 608, and along at least a portion of the inner wall 606, and have a shape designed to distribute energy along its surface. As shown, the grooves 610 have an arcuate shape that forms a rounded indentation in the surface between the faces of the sidewall 602. In other embodiments, the grooves 610 can have some other shape, such as a compound shape. Hinge points at which the sidewall 602 flexes in the z-axis (where the plane defined by the base 603 represents the x- and y-axes) can be defined by modifying the depth and width of the grooves 610, and the portions of the outer wall 604 and inner wall 606 that the grooves 610 extend through. As can be seen in FIGS. 6A, 6E and 6F, the grooves 610 extend from over the entire inner wall 606 to just above a flange at the base 603.

The faces of the sidewall 602 can optionally include one or more structures 614, 616 to stiffen the sidewall. As shown, the length-wise faces include slots 614 that can receive a second object smaller in cross-section in a direction transverse to the rectangular footprint of the cavity 612 that receives an object with a cross-section that approximately conforms to the rectangular footprint of the cavity 612. The slots 614 further can further act as stiffening structures for the walls. Further, the width-wise faces include stiffening structures 616. Because the faces of the sidewall 602 are segregated by the grooves 610 such that the bearing surfaces are substantially isolated from an impact below a designed-for magnitude in designed-for directions, the one or more structures can be designed to account for the stiffness of the individual face of the sidewall in which it is formed.

Figure 7A:
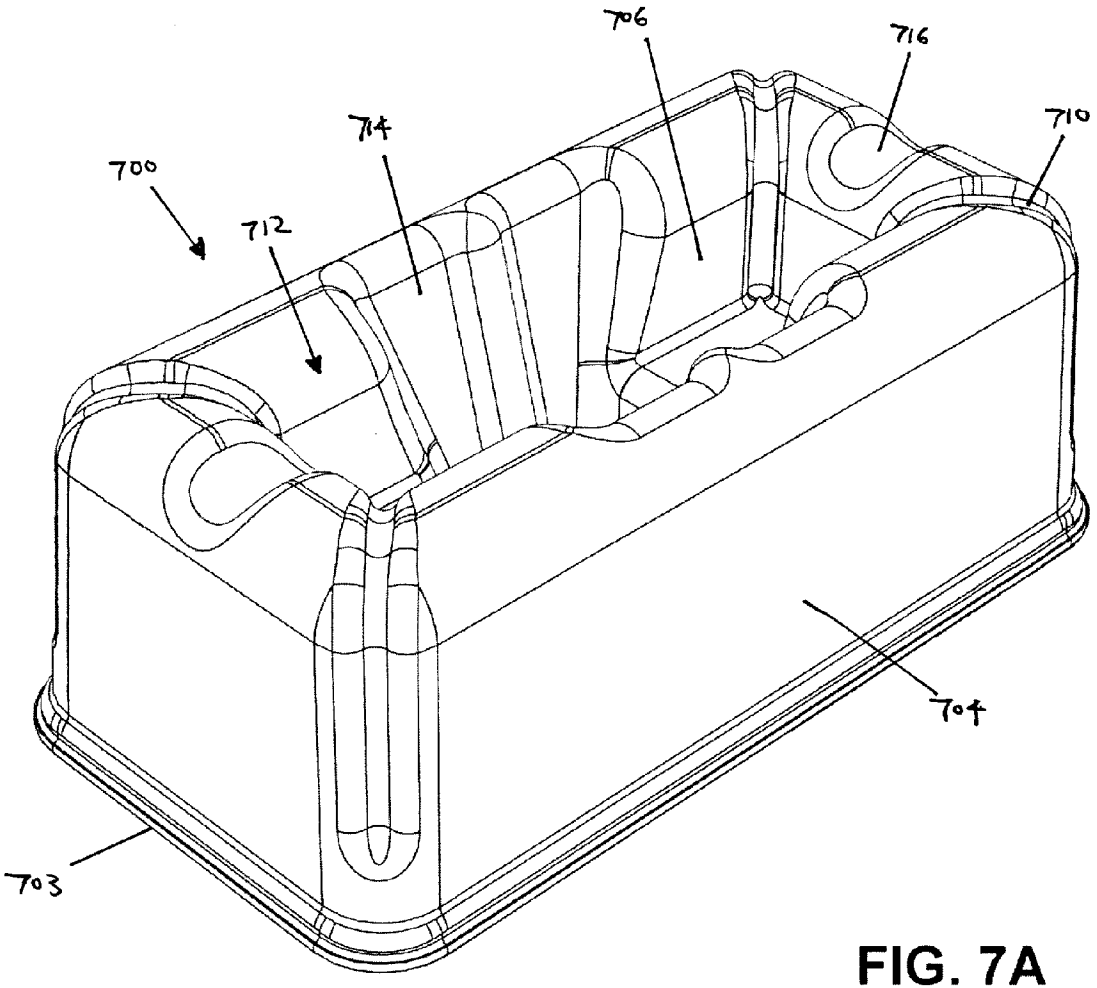
FIG. 7A is a perspective view of the energy dissipation structure.
Figure 7B:
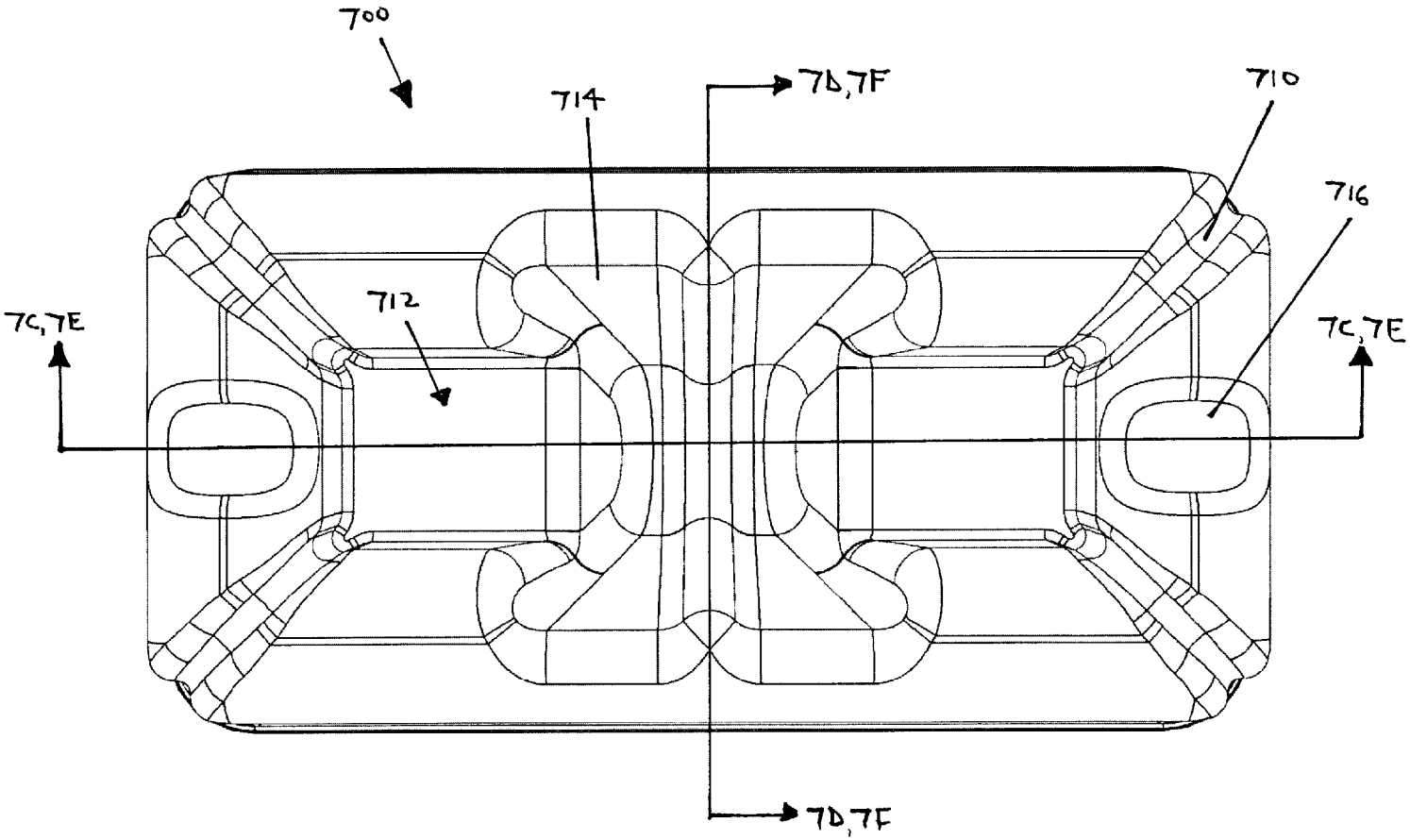
FIG. 7B is a top view of the energy dissipation structure.
Figure 7C:
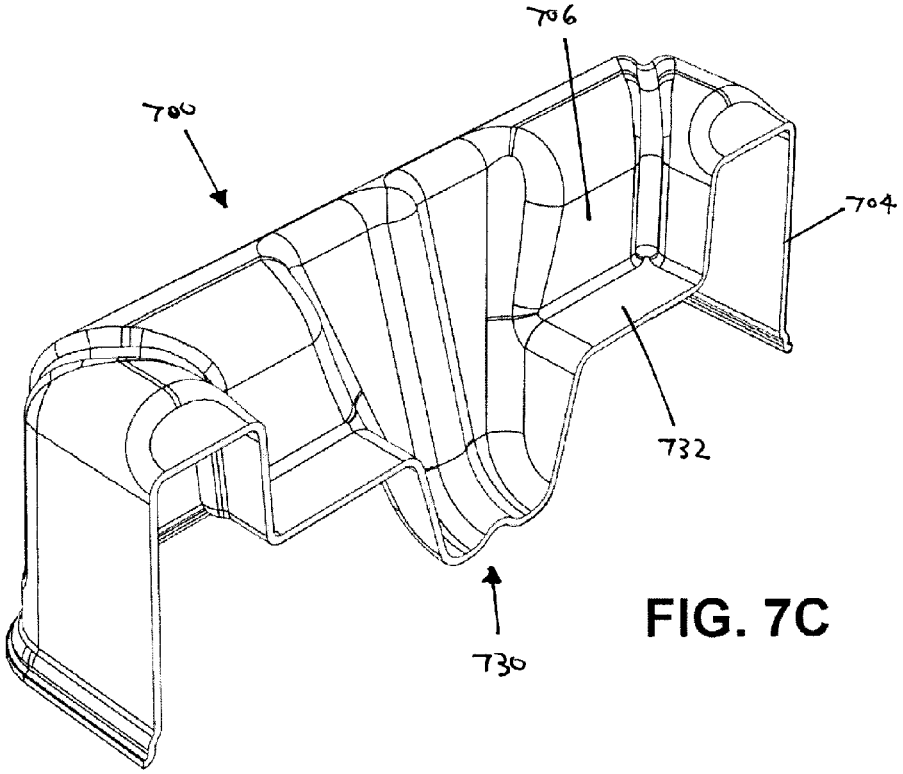
FIG. 7C is a perspective cross-sectional view along a length of the energy dissipation structure.
Figure 7D:
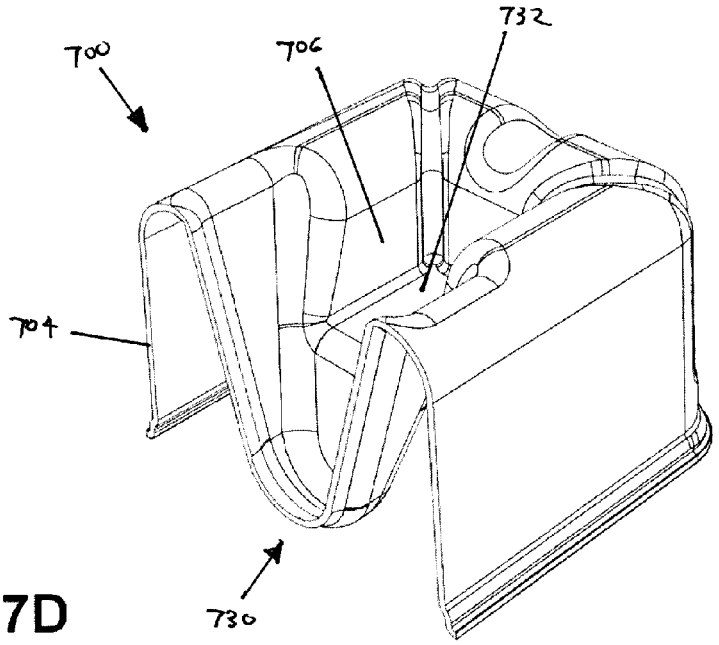
FIG. 7D is a perspective cross-sectional view along a width of the energy dissipation structure.

FIG. 7A illustrates an alternative embodiment of an energy dissipation structure 700 for supporting an article in accordance with the present invention. The energy dissipation structure 700 comprises a sidewall 702 having a plurality of faces (also referred to herein as sidewall structures) connected at corners by grooves 710 that segregate the bearing surfaces of the sidewall 702 from each other. The sidewall 702 defines a cavity 712 for receiving at least a portion of the article. Referring to FIG. 7B, a footprint of the cavity 712 can more clearly bee seen, and is generally rectangular in shape.

In preferred embodiments, the energy dissipation structure 700 can receive an end of the article and can be used in combination with an additional energy dissipation structure receiving an opposite end of the article. In addition, the energy dissipation structure 700 can be used in combination with additional structures receiving and supporting other portions of the article, such as structures arranged along and receiving the sides of the article.

Referring to FIGS. 7C-7F, the energy dissipation structure 700 includes a sidewall 702 having four faces defining a length and a width of the energy dissipation system 700. As mentioned, the footprint is approximately rectangular relative to a plane defined by a base 703 of the sidewall 702. The inner wall 706 is connected with a platform 732 that extends between the faces of the inner wall 706 to support an article above a plane defined by the base 703. Each of the faces of the sidewall 702 includes an outer wall 704 that acts as a bearing surface. Further, a support pillar 730 extends from the platform 732 to substantially a depth of the base 703, with a double arcuate structure defined by an arcuate rib extending inward of the cavity along the width of the arcuate structure 730. The platform 732 acts as the bearing surface when impacted by the supported article (not shown) from inside the cavity 712 and transfers impact forces at least partially to the support pillar 730, which can at least partially collapse and/or deform in response to the impact forces to thereby dissipate such impact forces.

Figure 7E:
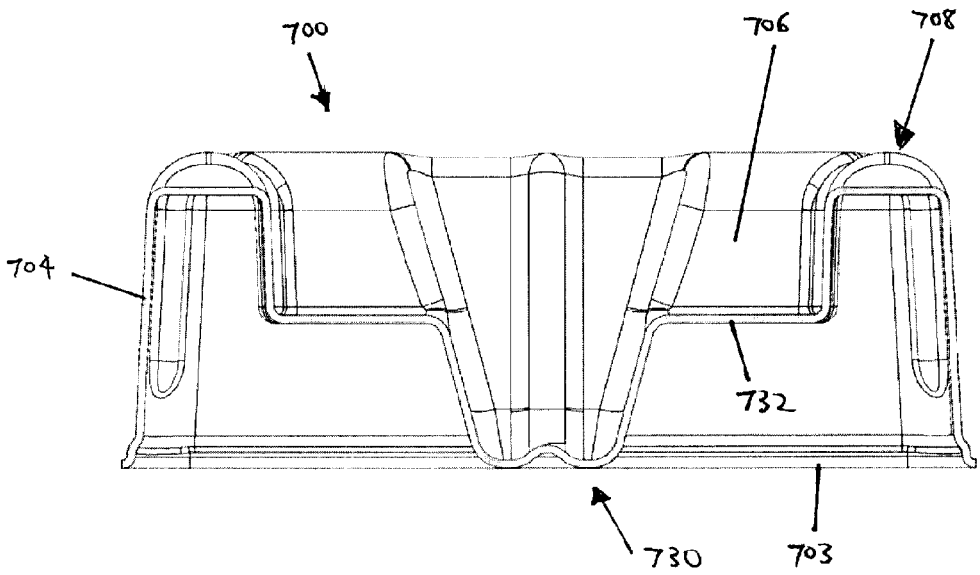
FIG. 7E is a cross-sectional view of the energy dissipation structure.
Figure 7F:
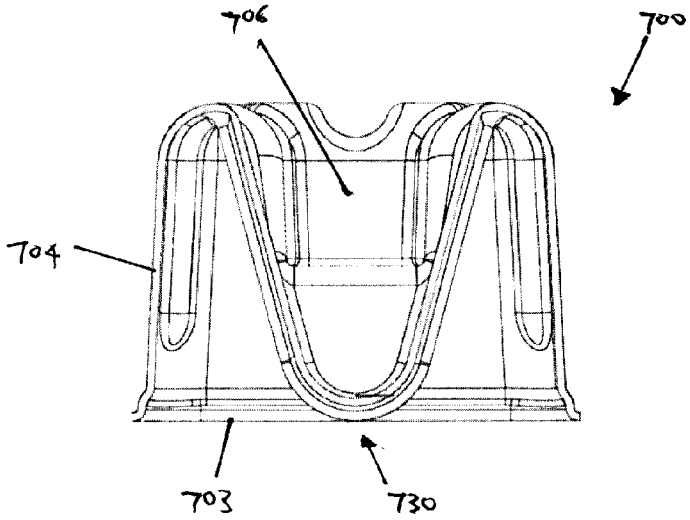
FIG. 7F is cross-sectional view of the energy dissipation structure.

The outer wall 704 and inner wall 706 are connected by a further arcuate structure 708. The grooves 710 extend along at least a portion of the outer wall 704, along the arcuate structure 708, and along at least a portion of the inner wall 706, and have a shape designed to distribute energy along its surface. As shown, the grooves 710 have an arcuate shape that forms a rounded indentation in the surface between the faces of the sidewall 702. In other embodiments, the grooves 710 can have some other shape, such as a compound shape. Hinge points at which the sidewall 702 flexes in the z-axis (where the plane defined by the base 703 represents the x- and y-axes) can be defined by modifying the depth and width of the grooves 710, and the portions of the outer wall 704 and inner wall 706 that the grooves 710 extend through. As can be seen in FIGS. 7A, 7E and 7F, the grooves 710 extend from over the entire inner wall 706 to just above a flange at the base 703.

The faces of the sidewall 702 can optionally include one or more structures 714, 716 to stiffen the sidewall. As shown, the length-wise faces each include a pair stiffening structures 714 joined at the support pillar 730 that extends from the platform 732 to approximately a depth of the base 703, and separated by the arcuate rib. Further, the width-wise faces include stiffening structures 616. Because the faces of the sidewall 702 are segregated by the grooves 710 such that the bearing surfaces are substantially isolated from an impact below a designed-for magnitude in designed-for directions, the stiffening structures 714, 716 can be designed to account for the stiffness of the individual face of the sidewall in which it is formed.

Figure 8A:
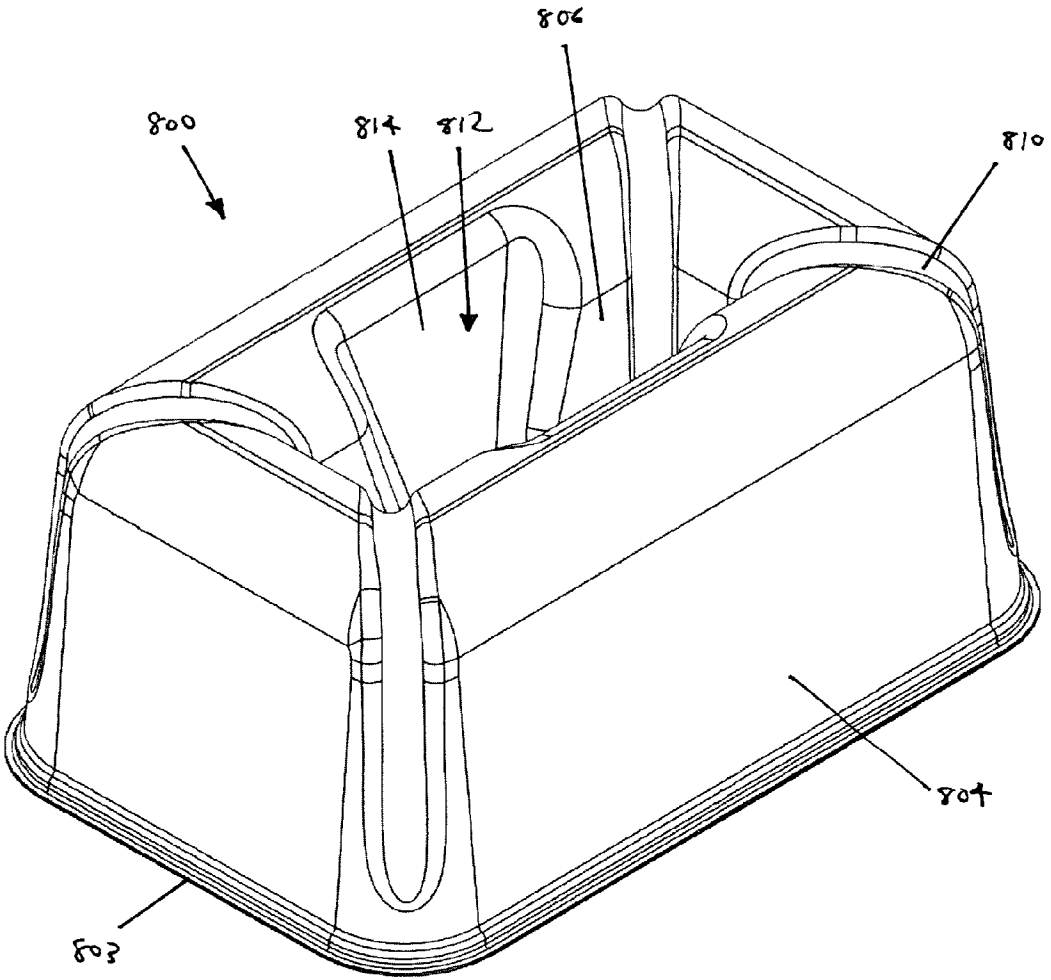
FIG. 8A is a perspective view of the energy dissipation structure.
Figure 8B:
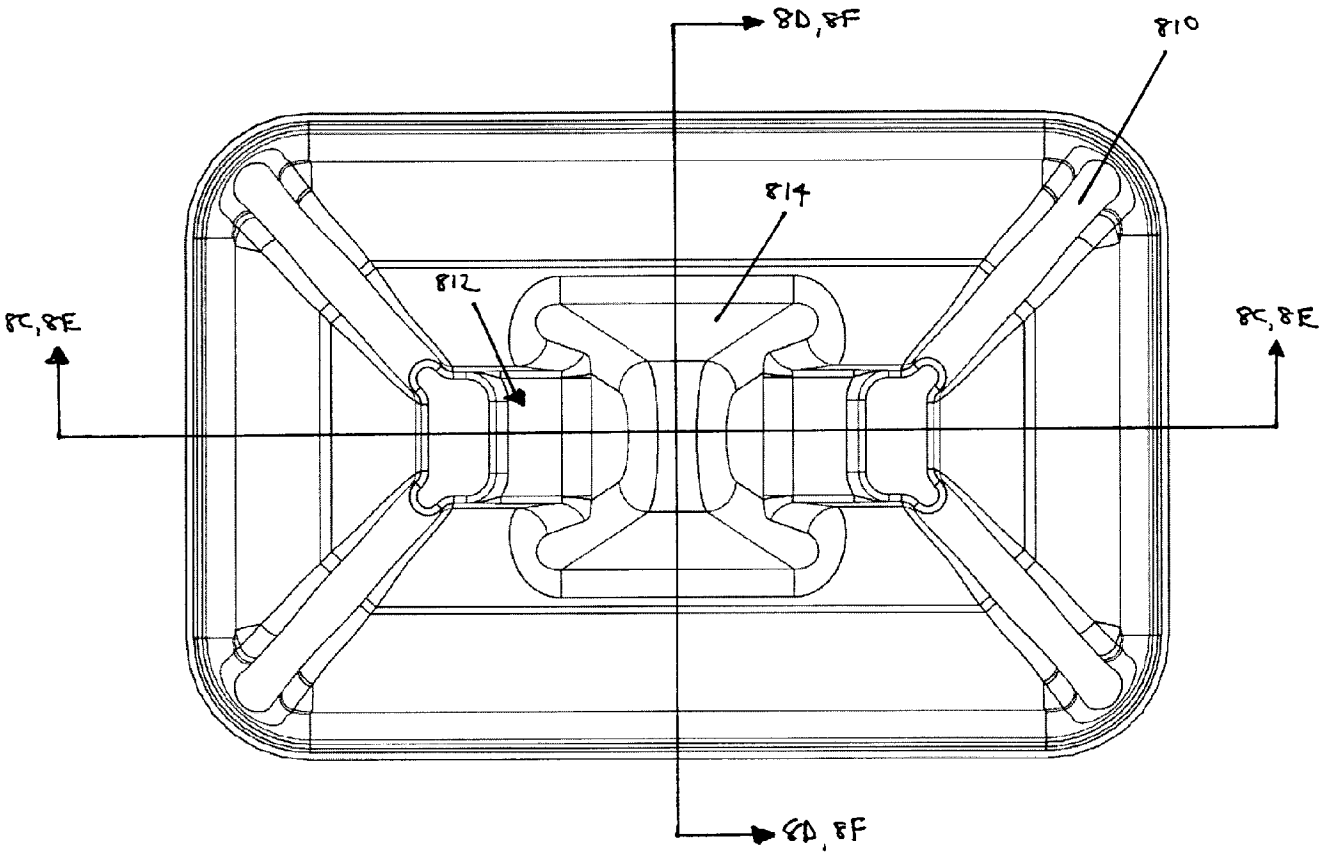
FIG. 8B is a top view of the energy dissipation structure.
Figure 8C:
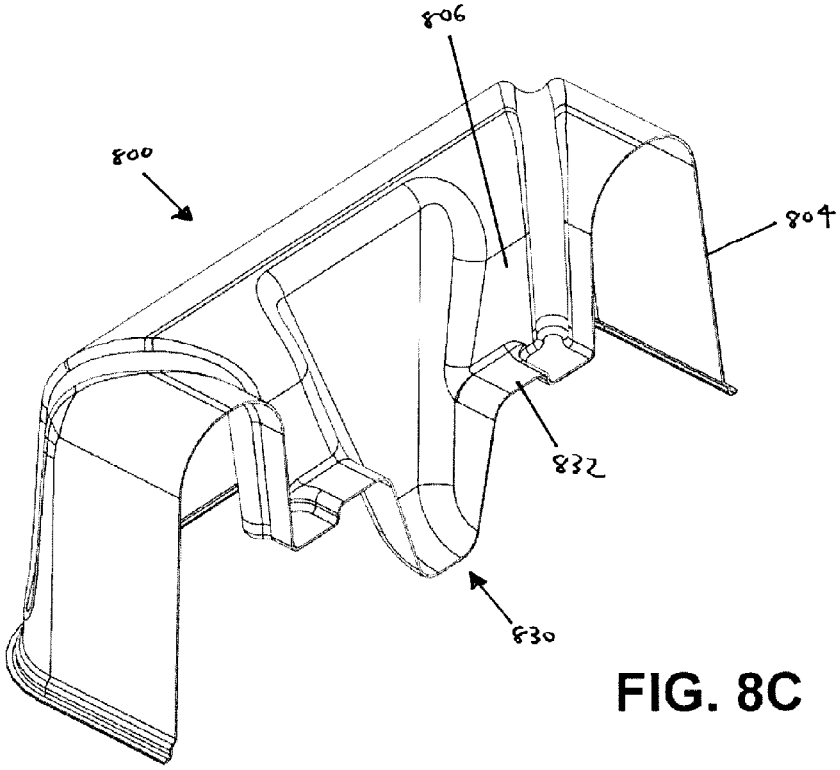
FIG. 8C is a perspective cross-sectional view along a length of the energy dissipation structure.
Figure 8D:
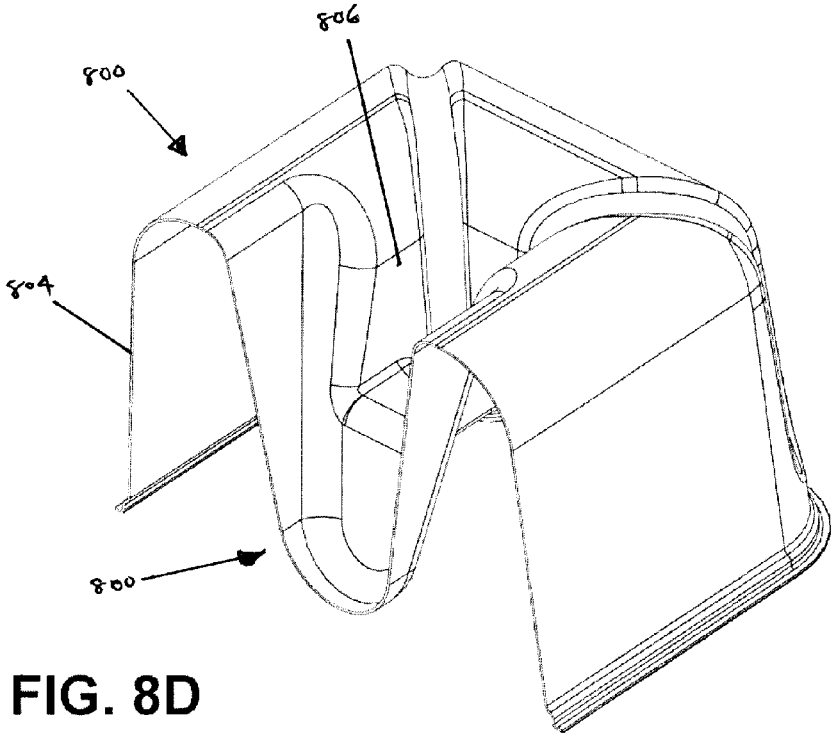
FIG. 8D is a perspective cross-sectional view along a width of the energy dissipation structure.

FIG. 8A illustrates an alternative embodiment of an energy dissipation structure 800 for supporting an article in accordance with the present invention. The energy dissipation structure 800 comprises a sidewall 802 having a plurality of faces (also referred to herein as sidewall structures) connected at corners by grooves 810 that segregate the bearing surfaces of the sidewall 802 from each other. The sidewall 802 defines a cavity 812 for receiving at least a portion of the article. Referring to FIG. 8B, a footprint of the cavity 812 can more clearly bee seen, and is generally rectangular in shape.

In preferred embodiments, the energy dissipation structure 800 can receive an end of the article and can be used in combination with an additional energy dissipation structure receiving an opposite end of the article. In addition, the energy dissipation structure 800 can be used in combination with additional structures receiving and supporting other portions of the article, such as structures arranged along and receiving the sides of the article.

Referring to FIGS. 8C-8F, the energy dissipation structure 800 includes a sidewall 802 having four faces defining a length and a width of the energy dissipation system 800. As mentioned, the footprint is approximately rectangular relative to a plane defined by a base 803 of the sidewall 802. The inner wall 806 is connected with a platform 832 that extends between the faces of the inner wall 806 to support an article above a plane defined by the base 803. Each of the faces of the sidewall 802 includes an outer wall 804 that acts as a bearing surface. Further, a support pillar 830 substantially extends from the platform 832 toward the base 803. However, unlike the previous embodiment, the support pillar 830 does not extend to the base 803, but rather extends to a depth just above the base 803. The platform 832 acts as the bearing surface when impacted by the supported article (not shown) from inside the cavity 812 and will collapse inward until the support pillar 830 contacts a surface, for example a surface that is flush with the base 803. The platform 832 can thereafter transfer impact forces at least partially to the support pillar 830, which can at least partially collapse and/or deform in response to the impact forces to thereby dissipate such impact forces.

Figure 8E:
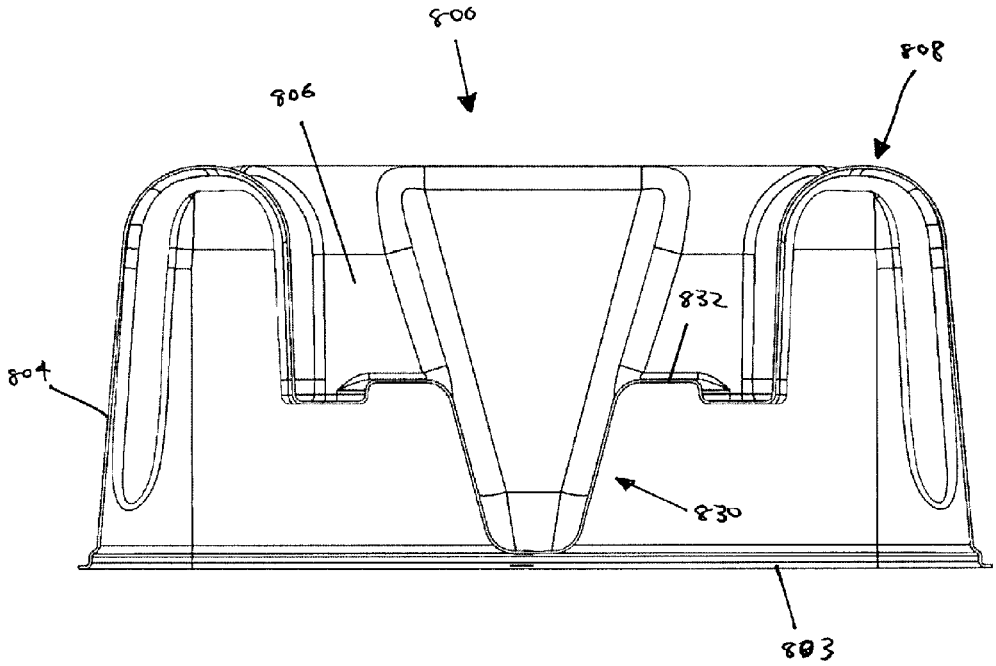
FIG. 8E is a cross-sectional view along the length of the energy dissipation structure.
Figure 8F:
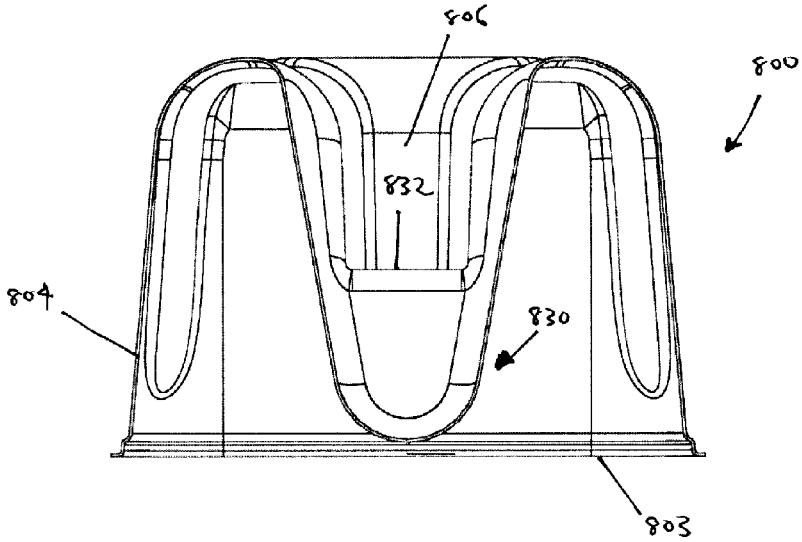
FIG. 8F is cross-sectional view along the width of the energy dissipation structure.

The outer wall 804 and inner wall 806 are connected by a further arcuate structure 808. The grooves 810 extend along at least a portion of the outer wall 804, along the arcuate structure 808, and along at least a portion of the inner wall 806, and have a shape designed to distribute energy along its surface. As shown, the grooves 810 have an arcuate shape that forms a rounded indentation in the surface between the faces of the sidewall 802. In other embodiments, the grooves 810 can have some other shape, such as a compound shape. Hinge points at which the sidewall 802 flexes in the z-axis (where the plane defined by the base 803 represents the x- and y-axes) can be defined by modifying the depth and width of the grooves 810, and the portions of the outer wall 804 and inner wall 806 that the grooves 810 extend through. As can be seen in FIGS. 8A, 8E and 8F, the grooves 810 extend from over the entire inner wall 806 to just above a flange at the base 803.

The faces of the sidewall 802 can optionally include one or more structures to stiffen the sidewall. As shown, the lengthwise faces include a stiffening structure 814 joined at the support pillar 830 that extends from the platform 832 toward the base 803. Because the faces of the sidewall 802 are segregated by the grooves 810 such that the bearing surfaces are substantially isolated from an impact below a designed-for magnitude in designed-for directions, the stiffening structures 814 can be designed to account for the stiffness of the individual face of the sidewall in which it is formed.

The foregoing description of preferred embodiments of the present invention has been provided for the purposes of illustration and description. It is not intended to be exhaustive or to limit the invention to the precise forms disclosed. Many modifications and variations will be apparent to one of ordinary skill in the relevant arts. For example, the energy dissipation structures described herein can be used to ship any kind of article, whether it is fragile or not. Further, the name "energy dissipation structure" does not necessarily mean the energy dissipation structures of the present invention hold the "ends" of the article. The embodiments were chosen and described in order to best explain the principles of the invention and its practical application, thereby enabling others skilled in the art to understand the invention for various embodiments and with various modifications that are suited to the particular use contemplated. It is intended that the scope of the invention be defined by the claims and their equivalence.

What is claimed is:

1. An energy dissipation structure for supporting an article, comprising:

a cavity adapted to receive at least a portion of the article;

wherein the cavity is bounded by a plurality of sidewall structures, each of the sidewall structures having a length and including an inner wall, an outer wall and an arcuate structure connecting the inner wall with the outer wall;

wherein each of the sidewall structures is connected with another of the sidewall structures by a groove extending along at least a portion of the inner walls, the outer walls, and the arcuate structures of the connected sidewall structures;

wherein the outer walls of the sidewall structures extends from a base to the arcuate structure, wherein the cavity includes a platform adapted to supported the article above the base when the article is seated within the cavity; and a support pillar extending from the platform toward the base.

2. The structure of claim 1, wherein the support pillar has an arcuate distal shape and extends approximately to the base.

3. The structure of claim 1, comprising four sidewall structures so that the structure has an approximately rectangular footprint.

4. The structure of claim 1, wherein the outer walls extend at an acute angle relative to the respective inner walls from the base to the arcuate structure.

5. The structure of claim 3, further comprising at least one rib extending from each of the outer walls, wherein the at least one rib includes a face that is substantially parallel to the respective inner walls.

6. The structure of claim 1, wherein the groove has an arcuate shape.

7. The structure of claim 1, wherein the groove has a compound shape having one or more arcuate shapes.

8. An energy dissipation structure for supporting an article, comprising:

a cavity adapted to receive at least a portion of the article;

wherein the cavity is bounded by four sidewall structures such that the energy dissipation structure has an approximately rectangular footprint, each of the sidewall structures having a length and including an inner wall, an outer wall, and an arcuate structure connecting the inner wall with the outer wall;

wherein the sidewall structures are connected at four corners by grooves extending along at least a portion of the inner walls, the outer walls, and the arcuate structures of the connected sidewall structures;

wherein the outer walls of the sidewall structures extends from a base to the arcuate structure;

wherein the cavity includes a platform adapted to supported the article above the base when the article is seated within the cavity; and a support pillar extending from the platform toward the base.

9. The structure of claim 8, wherein the support pillar has an arcuate distal shape and extends approximately to the base.

10. The structure of claim 8, wherein the outer walls extend at an acute angle relative to the respective inner walls from the base to the arcuate structure.

11. The structure of claim 9, further comprising at least one rib extending from each of the outer walls, wherein the at least one rib includes a face that is substantially parallel to the respective inner walls.

12. The structure of claim 8, wherein the groove has an arcuate shape.

13. The structure of claim 8, wherein the groove has a compound shape having one or more arcuate shapes.

14. An energy dissipation system for supporting an article, comprising:

a pair of energy dissipation structures, each including a cavity adapted to receive at least a portion of the article, wherein the cavity is bounded by four sidewall structures such that the energy dissipation structure has an approximately rectangular footprint, each of the sidewall structures having a length and including an inner wall, an outer wall, and an arcuate structure connecting the inner wall with the outer wall, wherein the sidewall structures are connected at four corners by grooves extending along at least a portion of the inner walls, the outer walls, and the arcuate structures of the connected sidewall structures, wherein the outer walls of the sidewall structures extends from a base to the arcuate structure;

wherein the cavity includes a platform adapted to supported the article above the base when the article is seated within the cavity, and a support pillar extending from the platform toward the base.

15. The system of claim 14, wherein the support pillar has an arcuate distal shape and extends approximately to the base.

16. The system of claim 14, wherein the outer walls of the pair of energy dissipation structures extend at an acute angle relative to the respective inner walls from the base to the arcuate structure.

17. The system of claim 16, wherein each of the energy dissipation structures further includes at least one rib extending from each of the outer walls, wherein the at least one rib includes a face that is substantially parallel to the respective inner walls.

18. The system of claim 14, wherein the grooves of the pair of energy dissipation structures have an arcuate shape.

19. The system of claim 14, wherein the grooves of the pair of energy dissipation structures have a compound shape having one or more arcuate shapes.

* * * * *